US005887898A

United States Patent [19]

Petrosino

[11] Patent Number: 5,887,898

[45] Date of Patent: Mar. 30, 1999

[54] SKATING/WALKING SUPPORT

[76] Inventor: Chris Petrosino, 245 East Dr., Copiague, N.Y. 11726

[21] Appl. No.: 641,521

[22] Filed: May 1, 1996

[51] Int. Cl.[6] ..... A63C 3/12

[52] U.S. Cl. ..... 280/825; 36/115

[58] Field of Search ..... 280/11.19, 11.27, 280/11.3, 43, 11.78, 11.22, 11.23, 7.13, 9, 7.14, 10, 825; 36/115

[56] References Cited

U.S. PATENT DOCUMENTS

| | | | |
|---|---|---|---|
| 3,983,643 | 10/1976 | Schreyer | 36/115 |
| 4,928,982 | 5/1990 | Logan | 280/11.22 |
| 4,988,122 | 1/1991 | Saunders | 780/841 |
| 5,615,901 | 4/1997 | Piotrowski | 280/7.14 |

*Primary Examiner*—Peter M. Poon
*Assistant Examiner*—C. T. Bartz
*Attorney, Agent, or Firm*—McAulay Nissen Goldberg Kiel & Hand, LLP

[57] ABSTRACT

A skating/walking support which includes a base, a first roller assembly, a first securing mechanism and a second securing mechanism. The base includes a support surface, a ground contact surface, and a first pivot element. The first roller assembly is pivotally connected to the first pivot element and is moveable relative to the base between first and second positions to effect a skating state and a walking state of the support, respectively. The first securing mechanism releasably secures the first roller assembly in the first position and the second securing mechanism releasably secures the first roller assembly in the second position.

12 Claims, 22 Drawing Sheets

SKATING/WALKING SUPPORT

BACKGROUND OF THE INVENTION

1. Field of the Invention

This invention relates to a multi-state support and, more particularly, to a support which provides skating and walking states.

2. Description of the Related Art

Roller skating has always been an exciting recreational sport. In order to provide rollers on which one may skate, it has been necessary to either remove one's shoes and replace them with roller skates or attach to one's shoes, removable skating assemblies. In either case, however, one must remove the skate in order to walk without significant difficulty. Examples of skates and skating assemblies which are known in the art are disclosed in U.S. Pat. No. 1,271,891, U.S. Pat. No. 1,616,442, U.S. Pat. No. 2,548,391, U.S. Pat. No. 3,306,623, U.S. Pat. No. 4,988,122, and U.S. Pat. No. 5,362,076. Each of the references listed above teaches a roller skate that must be removed to permit walking without significant difficulty.

U.S. Pat. No. 4,355,474 teaches a flexible sheet to be placed over the wheels of a traditional roller skate so as to provide a walking surface and thus, eliminate the need to remove the skates to permit walking. The sheet, however, must be removed from the skate and must be carried by the user. Since this sheet is removable, it is susceptible to loss.

U.S. Pat. No. 3,979,842, U.S. Pat. No. 3,983,643, U.S. Pat. No. 4,333,249, and U.S. Pat. No. 5,398,970 each illustrate mechanically positioned retractable rollers which may be stored in the shoe sole to provide a shoe or which may be extended from the sole to provide a skate. In each of the references teaching mechanically extending rollers, the height of the skate is increased due to the increased thickness of the sole to provide a storage location for the rollers, thus increasing the risk of serious ankle injury to the user while walking and/or skating.

U.S. Pat. No. 4,988,122 illustrates a skate which removably connects to a roller assembly or an ice skate assembly.

U.S. Pat. No. 3,971,144 illustrates a ski boot which is convertible to a walking shoe.

It is an object of the present invention to provide a support which converts easily between skating and walking states.

It is another object of the present invention to provide a support which easily stores the roller assembly without substantially increasing the distance of the support surface from the ground when the support occupies the walking and/or skating states.

It is a further objective of the present invention to minimize the risk of injury to a skater using the skating/walking shoe.

It is a further object of the present invention to provide a skating/walking shoe which converts between skating and walking states, the individual components thereof being attached to the support while the support occupies either the skating or the walking states.

BRIEF DESCRIPTION

The present invention provides means for positioning a roller assembly which permits the support to occupy either a skating or a walking state.

In a first embodiment, the roller assembly is pivotably mounted to a support. By pivoting the roller assembly relative to the support, the user moves the roller assembly between the skating and the walking states.

In a second embodiment, the roller assembly is both pivotable and translatable relative to the support. By pivoting and translating the roller assembly relative to the support, the user moves the roller assembly between the skating and the walking states.

In a third embodiment, the roller assembly is both pivotable and swivelable relative to the support. By pivoting and swivelling the roller assembly relative to the support, the user moves the roller assembly between the skating and the walking states.

In a fourth embodiment, the roller assembly is slidable relative to the support. By sliding the roller assembly relative to the support, the user moves the roller assembly between skating and walking states.

DETAILED DESCRIPTION OF THE PREFERRED EMBODIMENTS

Figure 1:
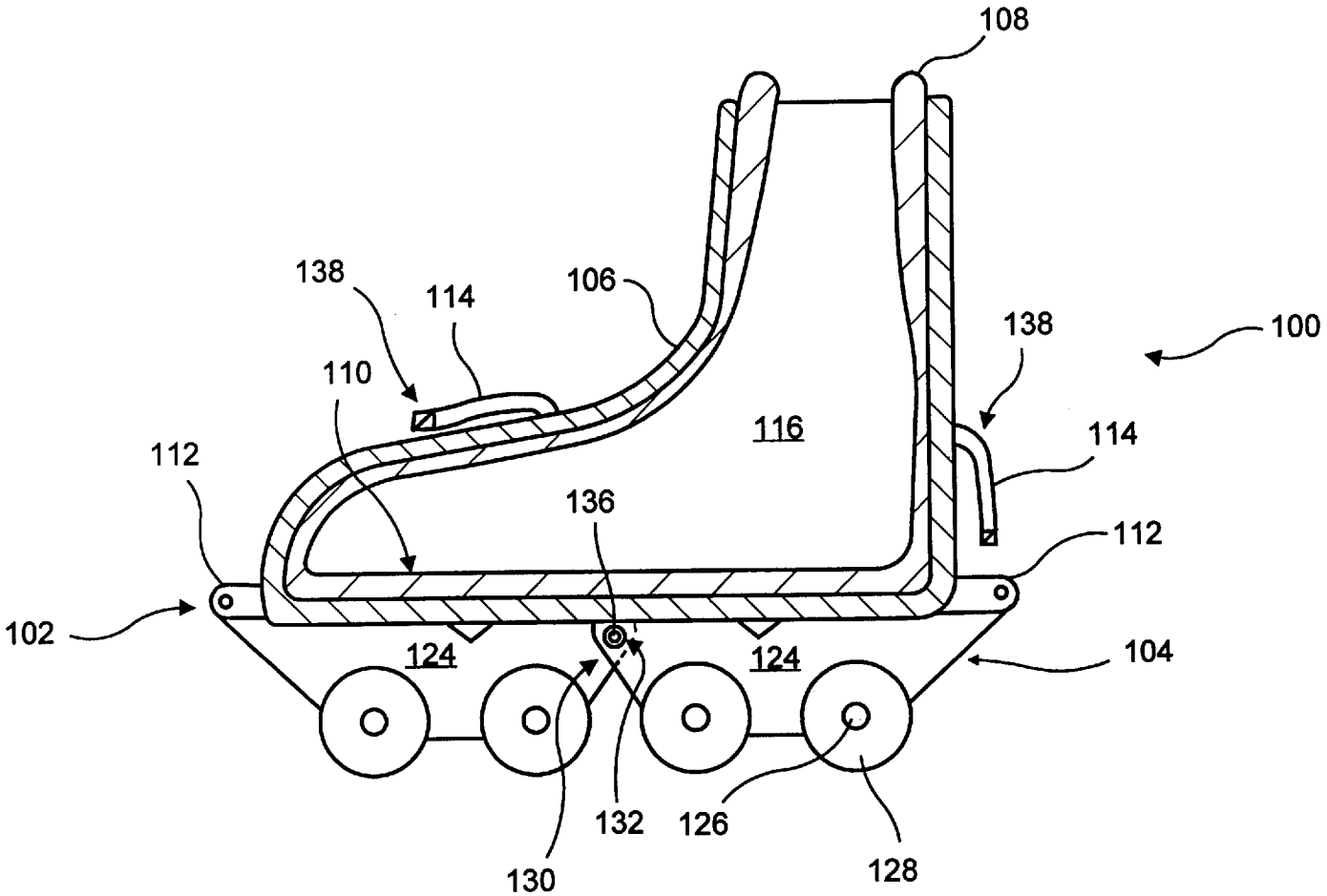
FIG. 1 is a longitudinal, cross-sectional view of a skating/walking support constructed in accordance with the first embodiment of the present invention. The support illustrated in FIG. 1 occupies the skating state.
Figure 2:
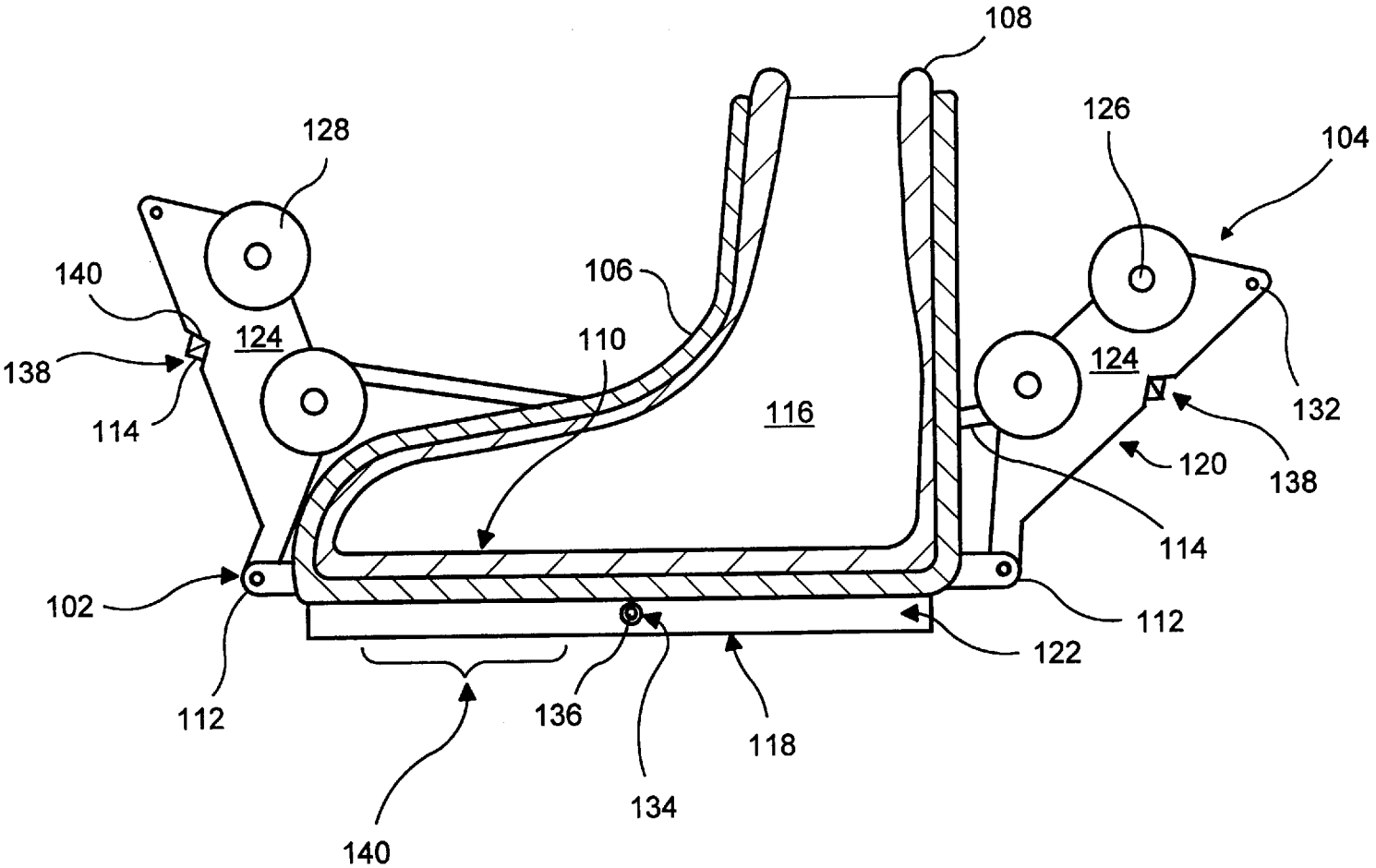
FIG. 2 is a cross-sectional view similar to FIG. 1, however, the support illustrated in FIG. 2 occupies the walking state.

Referring to FIGS. 1 and 2, support 100 according to a first embodiment of the present invention provides base 102 and roller assembly 104. As illustrated in FIG. 1, base 102 provides foot enclosure 106, padding 108, user support surface 10, pivot element 112, and retention loop 114. Foot enclosure 106 defines foot enclosure cavity 116.

Referring to FIG. 2, base 102 provides first contact surface 118 and roller assembly 104 provides contact surface 120. The contours of contact surfaces 118 and 120 are complimentary so that base 102 and roller assembly 104 mate when support 100 is placed in the skating state as illustrated in FIG. 1.

Base 102 further defines longitudinal stabilizing channel 122. Longitudinal channel 122 is adapted to mate with a complimentary portion of surface 120 of roller assembly 104 to position and stabilize roller assembly 104 when support 100 occupies the skating state.

Roller assembly 104 provides roller support 124, axel and bearings 126, and rollers 128. When roller support 124 engages longitudinal channel 122, roller assembly 104 occupies the skating state.

Either roller assembly 104 or base 102 or both roller assembly 104 and base 102 provide means 130 for releasably securing roller assembly 104 to base 102. Releasable securing means 130 may be selected from any one of the following structures: alignable opening(s) and a mating removable pin, spring biased protrusions and alignable mating opening(s) or indentation(s), a releasable clip, a slide and alignable mating opening(s), strap(s), belt(s) or any equivalent structure. As illustrated in FIGS. 1 and 2, releasable securing means 130 includes aligned openings 132, 134 in roller support 124 and base 102, respectively, and corresponding removable mating pin 136.

Support 100 provides releasable roller securing means 138 for releasably securing roller assembly 104 in the walking position. Releasable roller securing means 138 for releasably securing roller assembly 104 in the walking position may be selected from the group of releasably securing structures discussed previously with regard to releasably securing means 130. As illustrated in FIGS. 1 and 2, releasable roller securing means 138 provides elastic loop 114. Roller support 104 provides groove 140 for positioning loop 114 with respect to roller support 104.

It is preferable that base 102 provides resilient zone 140 which is adapted to align with the ball of a skater's foot. While support 100 occupies the walking state, base 102 is flexible, at least in resilient zone 140, to facilitate comfortable walking when support 100 occupies the walking state. Roller support 124 is sufficiently rigid so as to minimize flexibility in resilient zone 140 to facilitate comfortable skating when support 100 occupies the skating state.

First contact surface 118 acts as a ground contact surface when support 100 occupies the walking state and may provide treads to minimize slipping.

Figure 22:
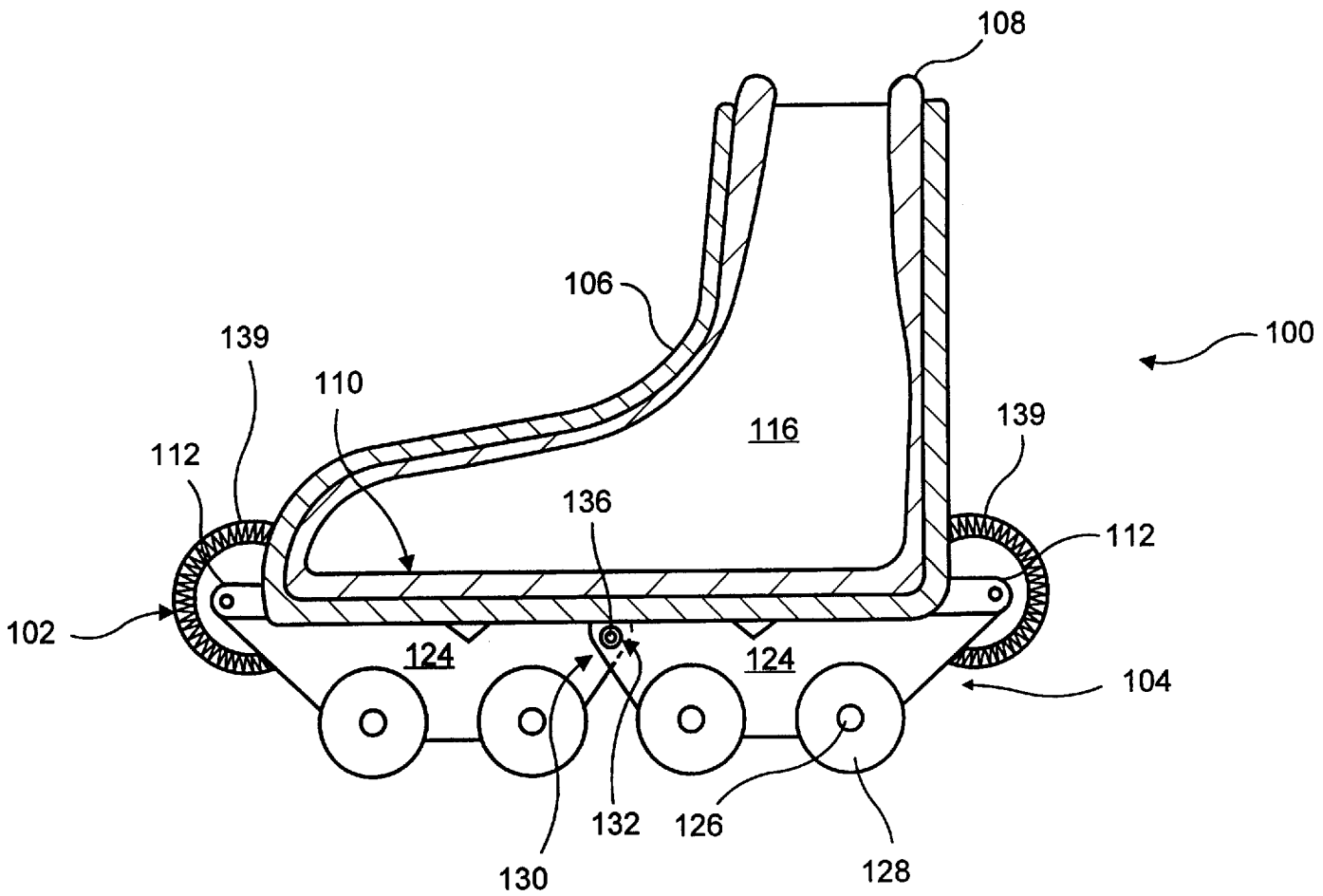
FIG. 22 is a view similar to FIG. 1, illustrating a variation in structure.

Referring to FIG. 22, releasable roller securing means 138 are replaced with spring member 139. Spring member 139 biases roller assembly 104 to place support 100 into the walking state. Accordingly, when releasable securing means 130 permits movement of roller assembly 104 relative to base 102, spring member 139 biases roller assembly 104 to place support 100 into the walking state.

Figure 3:
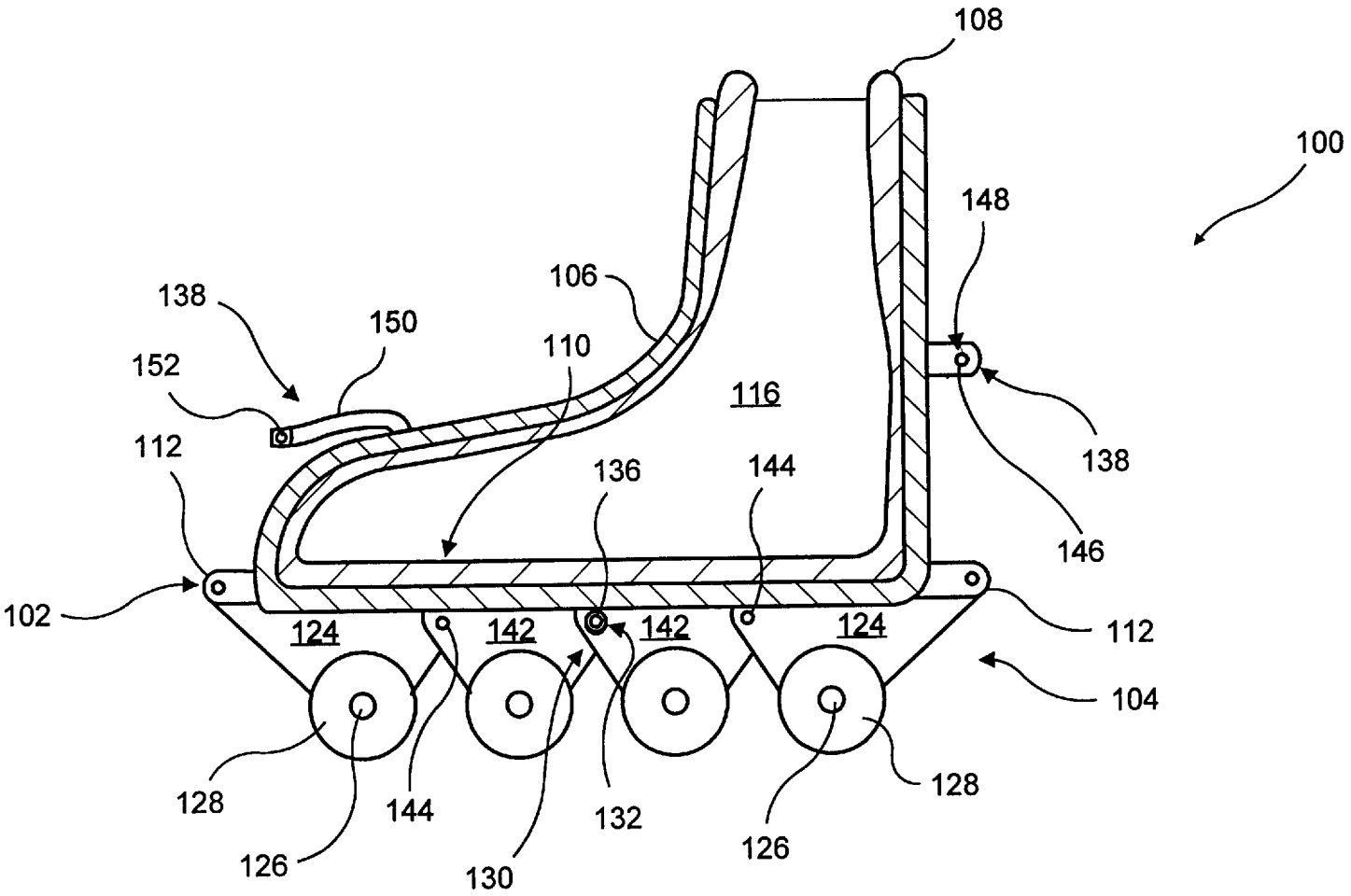
FIG. 3 is a longitudinal, cross-sectional view of an alternate skating/walking support constructed in accordance with the first embodiment of the present invention. The support illustrated in FIG. 3 occupies the skating state.
Figure 4:
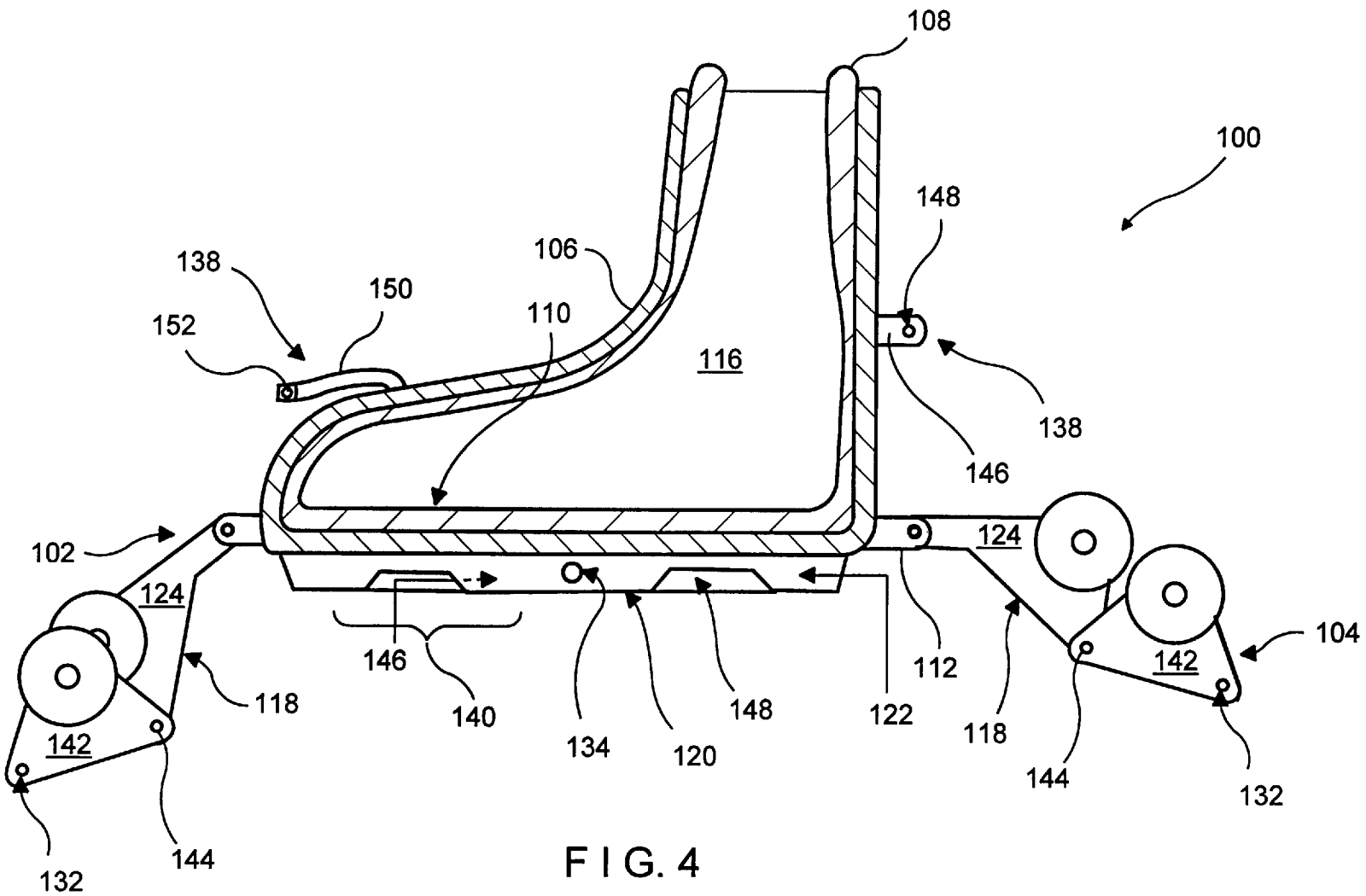
FIG. 4 is a view similar to FIG. 3, however, the support illustrated in FIG. 4 is in transition from the skating state to the walking state.
Figure 5:
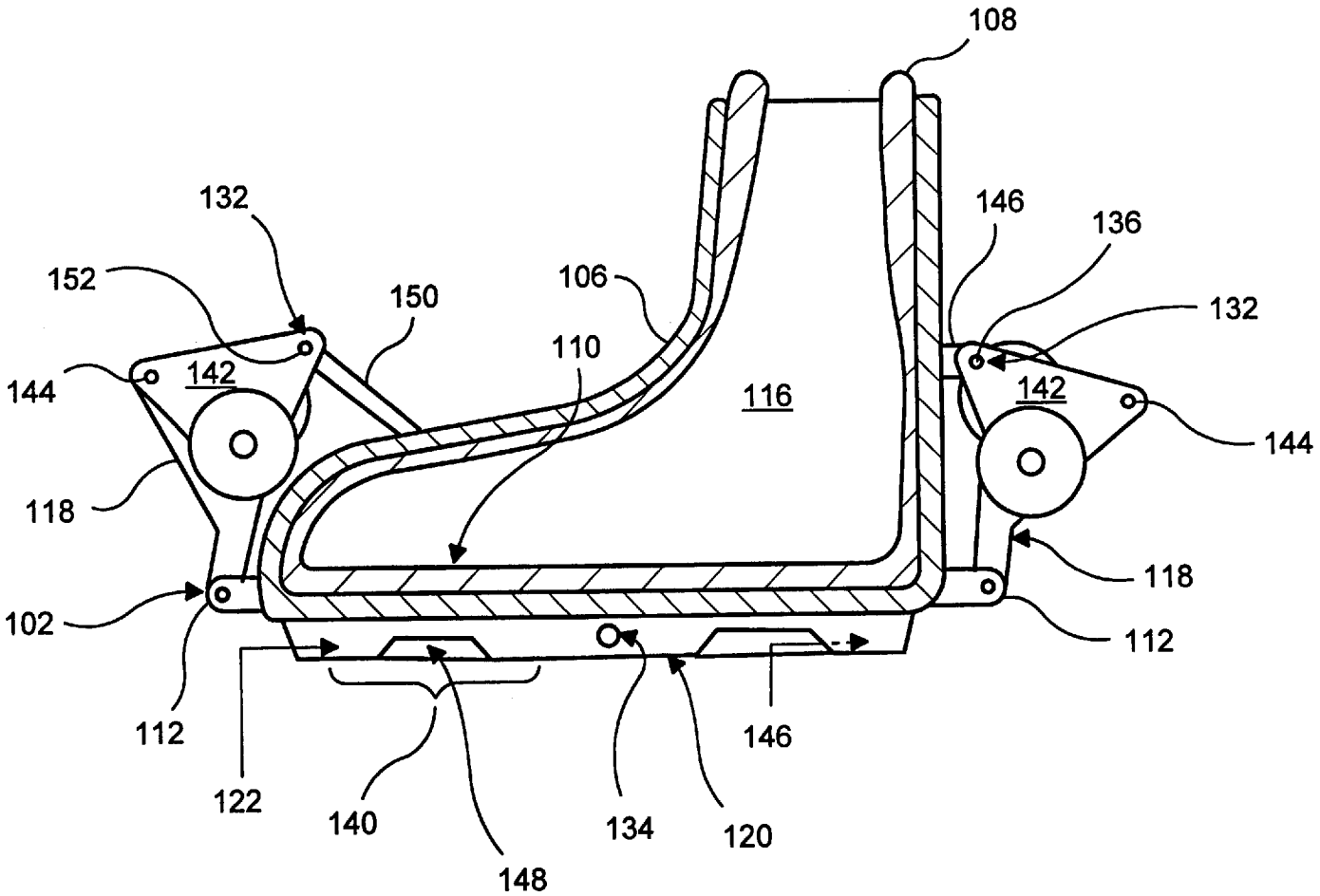
FIG. 5 is a cross-sectional view similar to FIG. 3, however, the support illustrated in FIG. 5 occupies the walking state.

Referring to FIGS. 3 through 5, support 100 according to the first embodiment of the invention provides base 102 and roller assembly 104. For purposes of convenience and brevity, elements discussed herein which have been discussed with regard to alternate supports and/or embodiments, are assigned the same identification numeral as the element previously disclosed.

Roller assembly 104 includes first roller support 124 and second roller support 142. First roller support 124 and second roller support 142 are pivotably interconnected by hinge 144. First roller support 124 is pivotably connected to pivot 112 and second roller support provides opening 132 which forms part of releasable securing means 130.

Base 102 provides first and second interconnected stabilizing channels 122, 146, respectively. Stabilizing channels 122, 146 are interconnected by channel 148. Channel 148 receives hinge 144, stabilizing channel 146 receives first roller support 124, and stabilizing channel 122 receives second roller support 142 when support 100 occupies the skating state.

Upon removal of pin 136, the user may change the state occupied by support 100. As illustrated in FIGS. 4 and 5, during transition from the skating state to the walking state, second roller support 142 is pivoted relative to first roller support 124 and roller assembly 104 is pivoted relative to base 102. In order to facilitate the relative movement of first roller support 124 to second roller support 142, first and second roller supports 124, 142 may arrange rollers 128 in a non-linear arrangement when support 100 occupies the skating state.

As illustrated in FIG. 3, releasable roller securing means 138 positioned at the rear of support 100 includes bracket 146 having opening 148. Releasable roller securing means 138 positioned at the front of support 100 includes belt 150 and pin 152 attached thereto. Referring to FIG. 5, support 100 occupies the walking state when opening 132 of roller support 142 is aligned with opening 148 in bracket 146 and pin 136 is inserted therethrough to maintain the rear portion of roller assembly 104 behind support 100 and when opening 132 of roller support 142 receives pin 152 to maintain the front portion of roller assembly 104 in front of support 100. Bracket 146 and/or belt 150 may be resilient to facilitate positioning of the portions of roller assembly 104.

Figure 6:
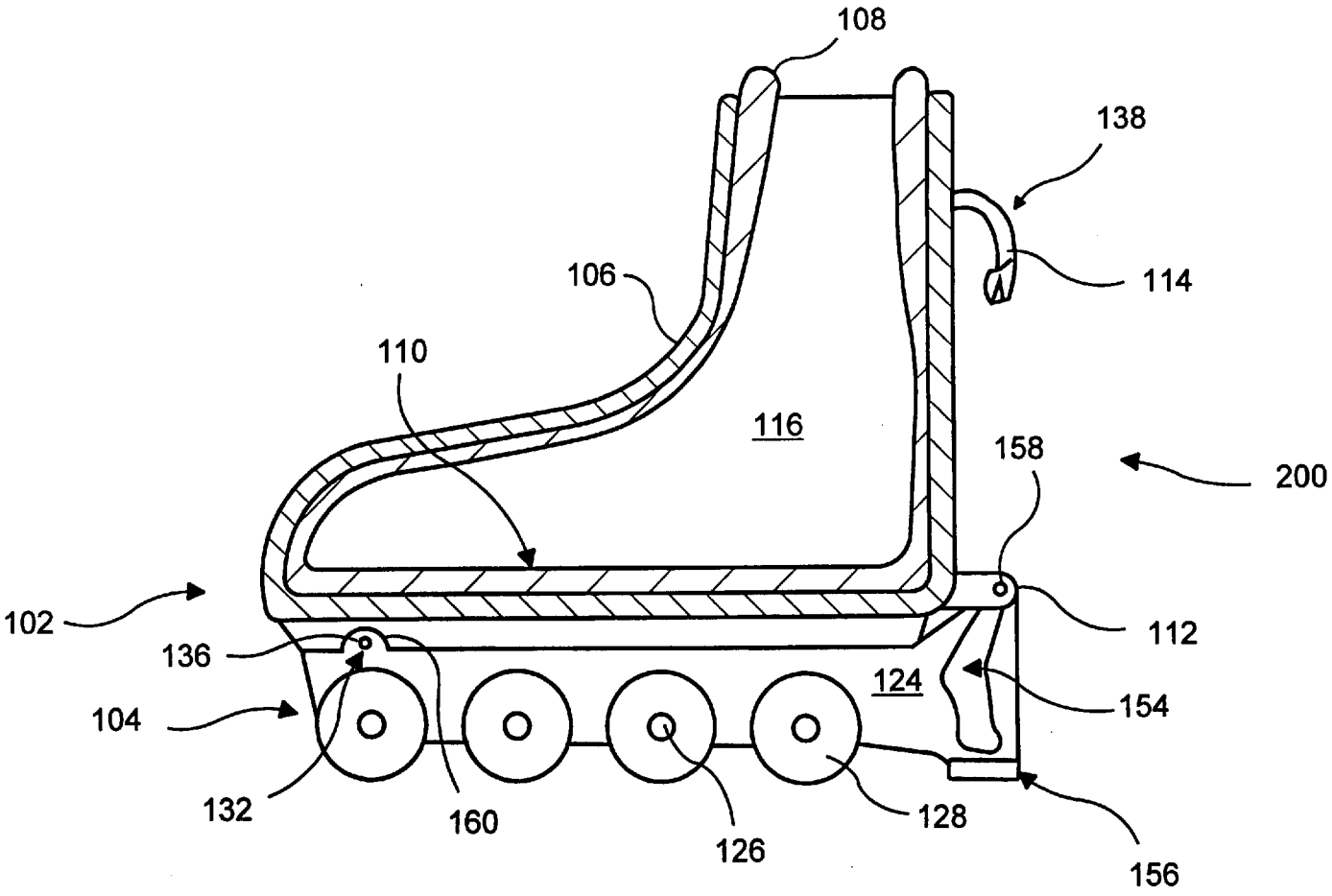
FIG. 6 is a longitudinal, cross-sectional view of a skating/walking support constructed in accordance with the second embodiment of the present invention. The support illustrated in FIG. 6 occupies the skating state.
Figure 7:
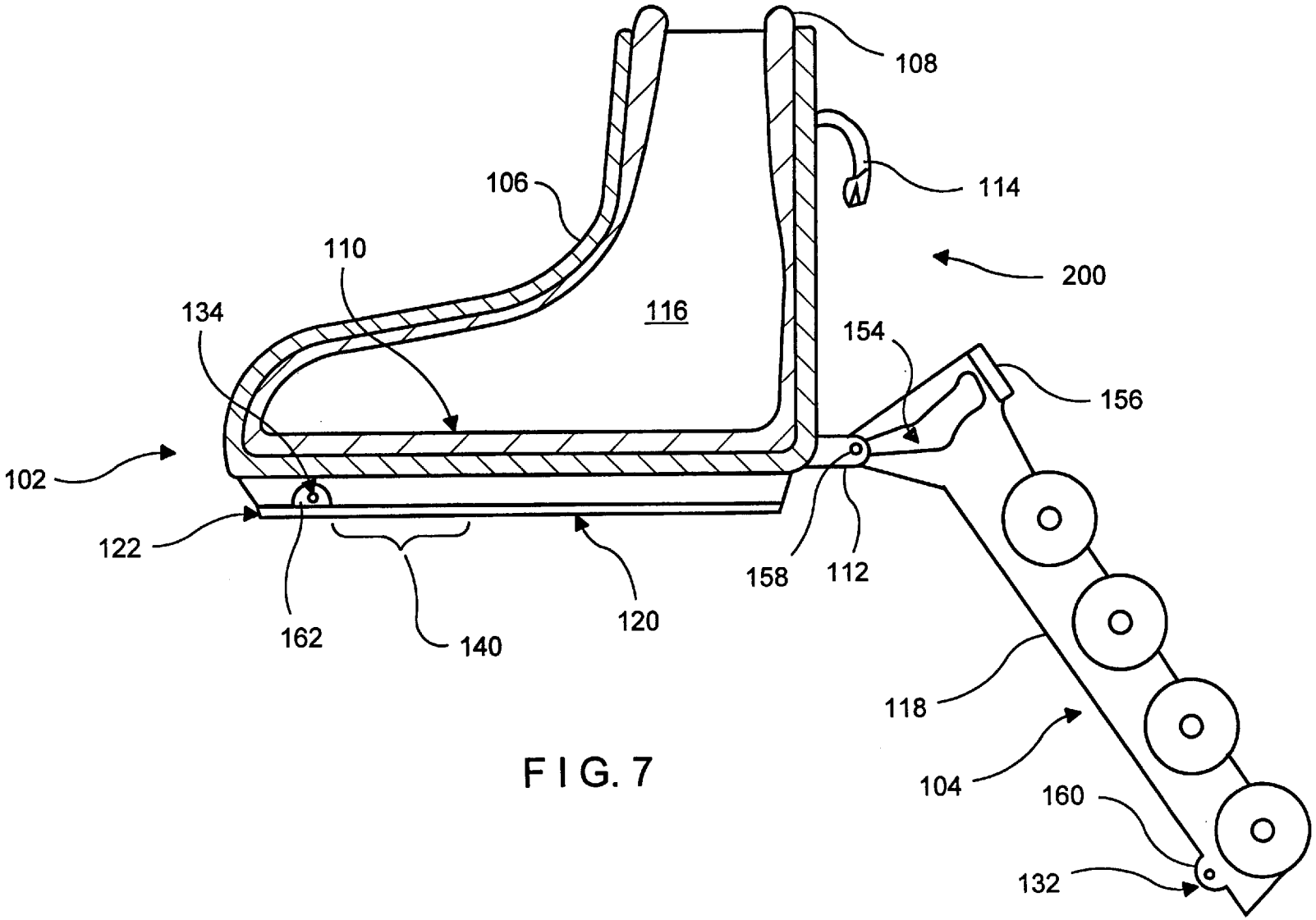
FIG. 7 is a view similar to FIG. 6, however, the support illustrated in FIG. 7 is in transition from the skating state to the walking state.
Figure 8:
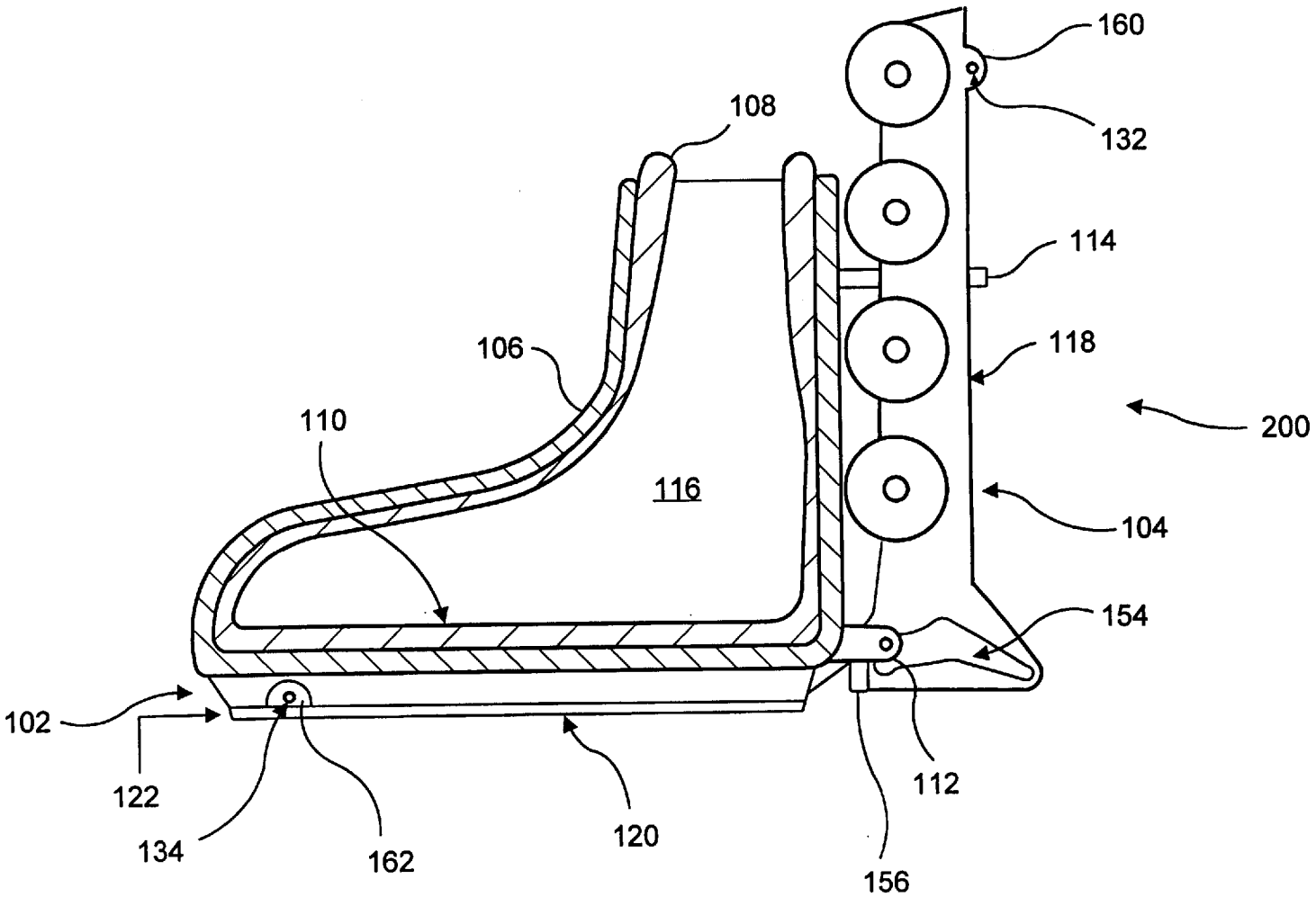
FIG. 8 is a cross-sectional view similar to FIG. 6, however, the support illustrated in FIG. 8 occupies the walking state.

Referring to FIGS. 6 through 8, support 200 according to a second embodiment of the invention provides base 102 and roller assembly 104. Roller assembly 104 includes roller support 124. Roller support 124 provides opening 154 and brake 156. Opening 154 receives pin 158 of pivot 112 to permit movement of roller support 124 relative to pivot 112. Roller support 124 also provides shoulder 160 having opening 132 therein.

Base 102 provides stabilizing channel 122 recess 162, and opening 134. Stabilizing channel 122 receives roller support 124, recess 162 receives shoulder 160, openings 132 and 134 are aligned and receive removable pin 136, when support 200 occupies the skating state. Channel 122 may be longitudinal (as shown) or transverse. A combination of longitudinal and transverse channels is anticipated herein.

Upon removal of pin 136, the user may change the state occupied by support 200. As illustrated in FIGS. 7 and 8, during transition from the skating state to the walking state, roller support 124 is pivoted relative to base 102 and is translated relative to pivot 112.

Opening 154 is shaped to permit both pivoting and translation of roller assembly 104 relative to base 102.

Figure 9:
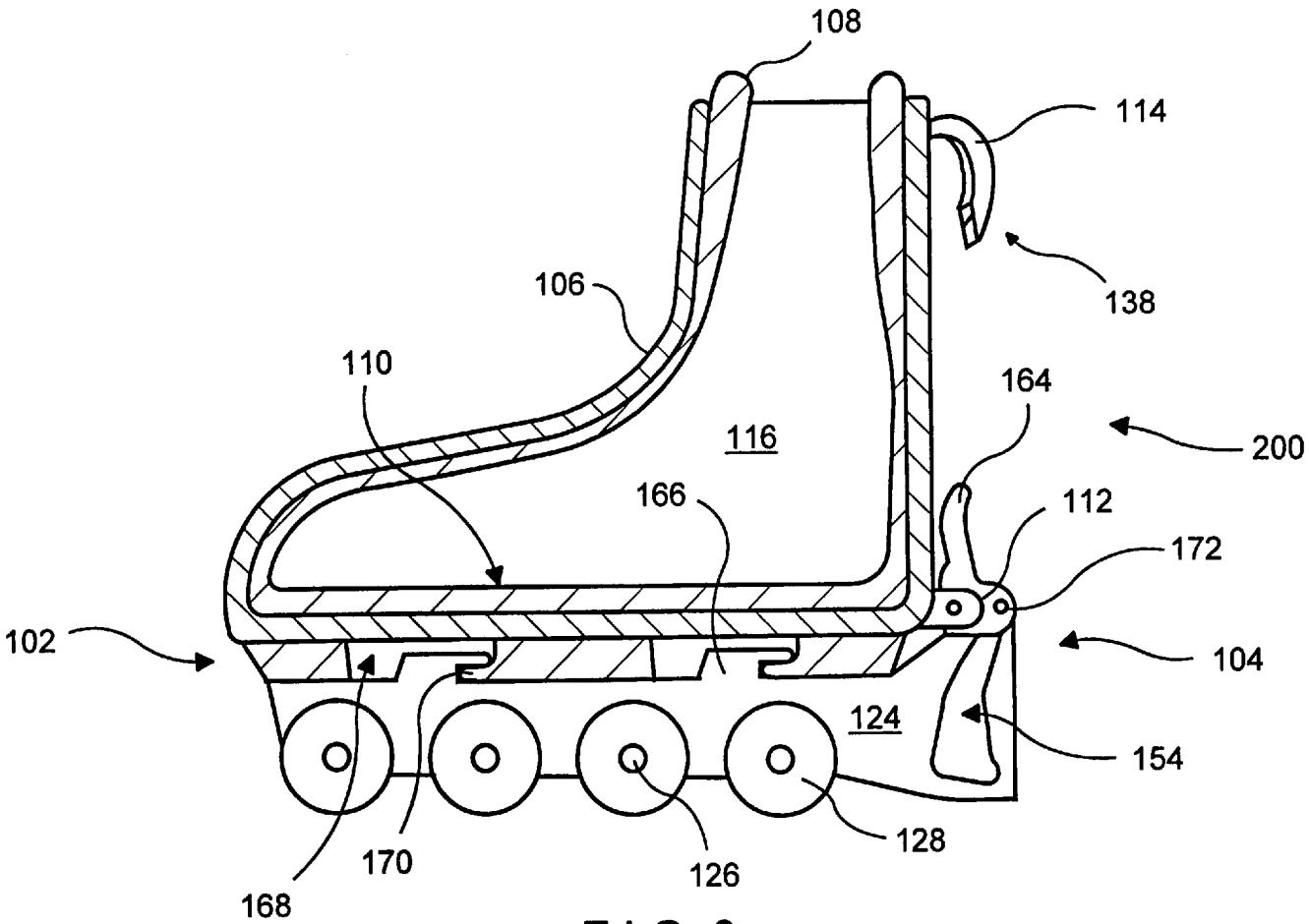
FIG. 9 is a longitudinal, cross-sectional view of a skating/walking support constructed in accordance with the second embodiment of the present invention. The support illustrated in FIG. 9 occupies the skating state.
Figure 10:
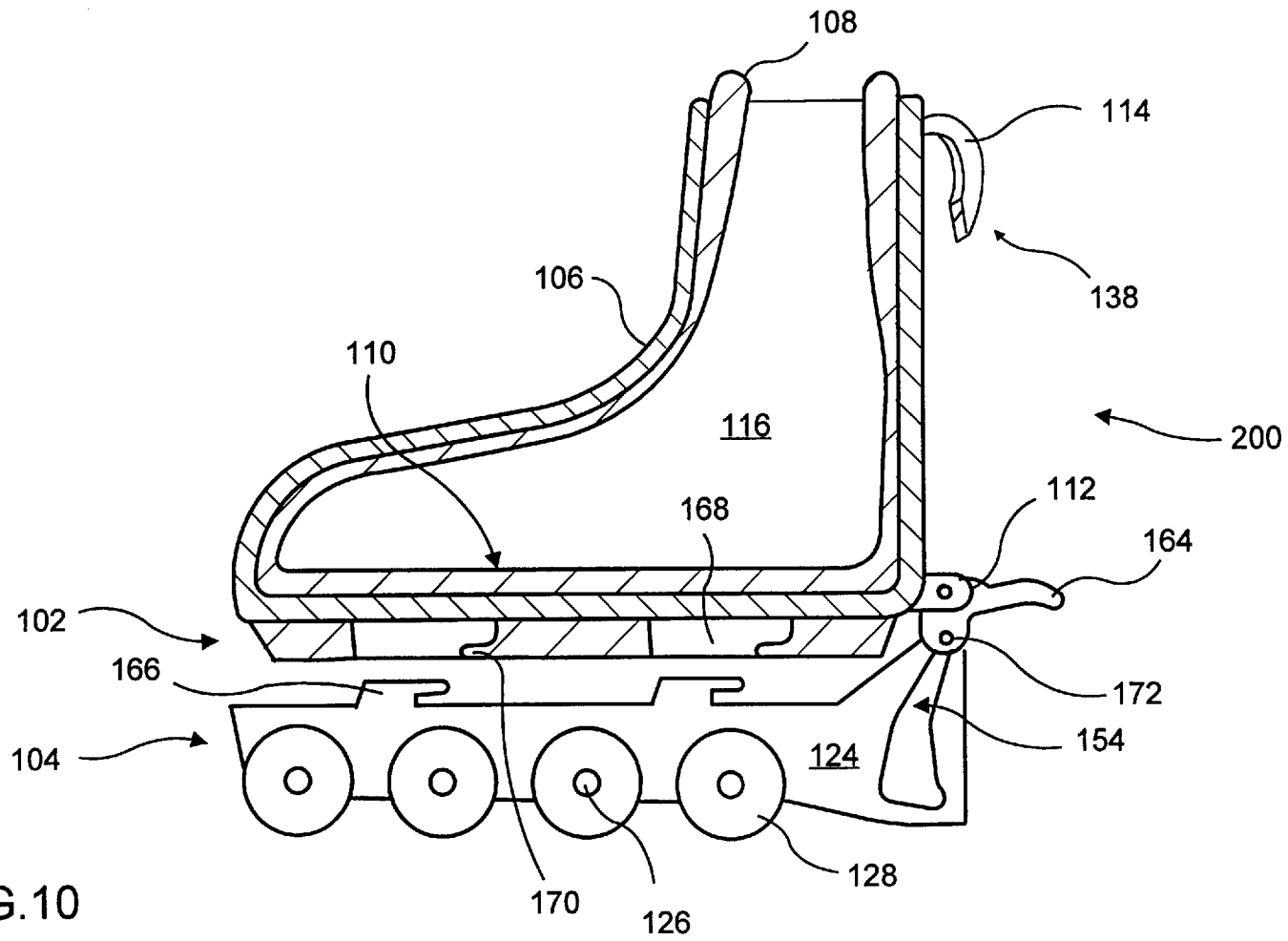
FIG. 10 is a view similar to FIG. 9, however, the support illustrated in FIG. 10 is in transition from the skating state to the walking state.
Figure 11:
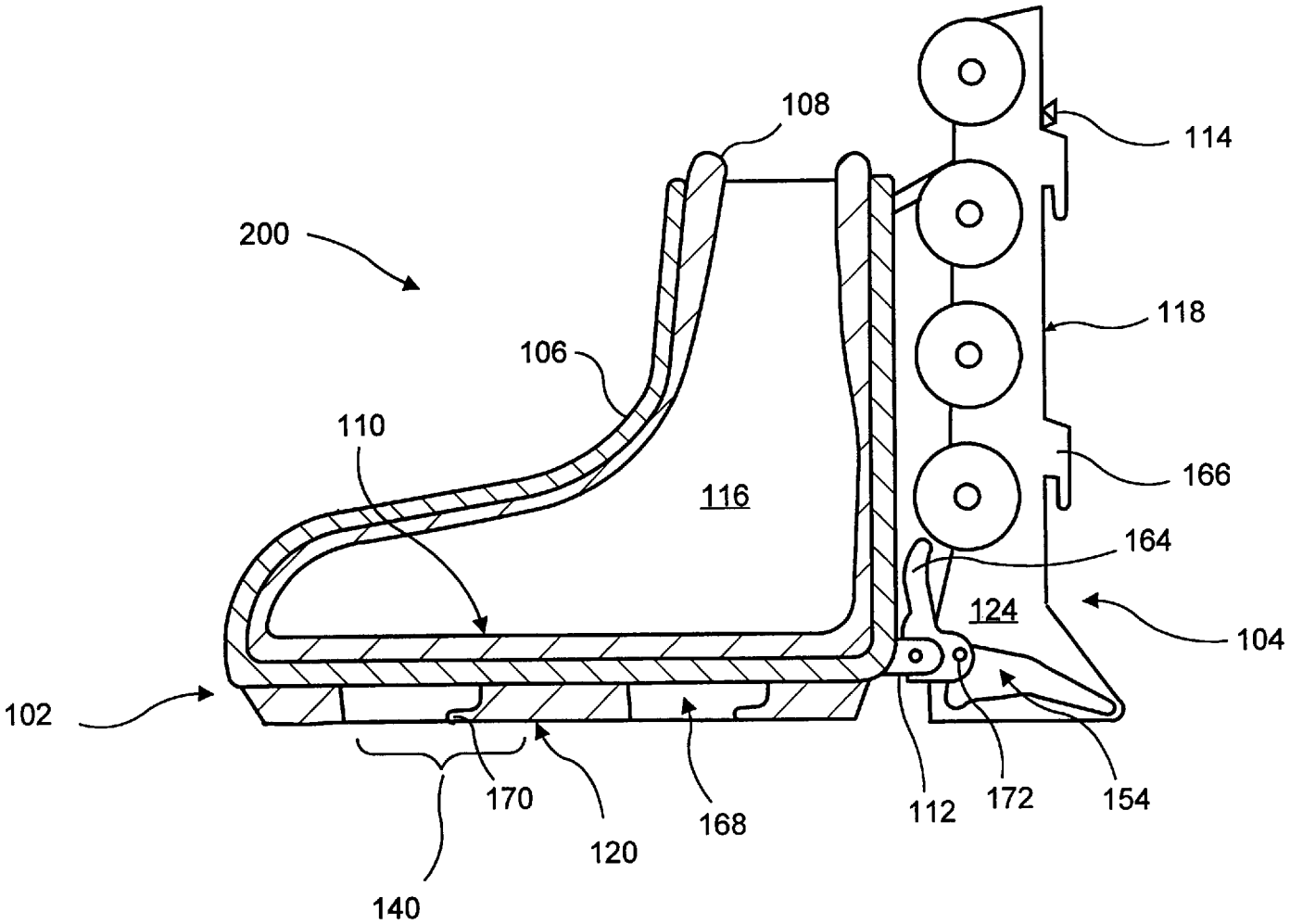
FIG. 11 is a cross-sectional view similar to FIG. 9, however, the support illustrated in FIG. 11 occupies the walking state.

Referring to FIGS. 9 through 11, support 200 according to the second embodiment of the invention provides base 102 and roller assembly 104. Roller assembly 104 includes roller support 124 and pivot lock 164. Roller support 124 is pivotably connected to pivot lock 164 and pivot lock 164 is pivotably connected to pivot 112. Roller support 124 is translatable relative to pivot lock 164.

Roller support 124 provides at least one locking element 166 each of which is adapted to be removably received in a mating opening 168 in base 102. Mating opening 168 receives locking element 166 of roller support 124 when support 200 occupies the skating state.

Upon release of pivot lock 164, the user may change the state occupied by support 200. As illustrated in FIGS. 10 and 11, during transition from the skating state to the walking state, pivot lock 164 is rotated to permit translation of roller support 124 relative to base 102. Roller support 124 is translated relative to base 102 until locking elements 166 disengage shoulders 170 of base 102. Roller support 124 is then pivoted relative to base 102 and secured to achieve the walking state.

Preferably, roller support 104 provides opening 154 adapted to receive pin 172 of pivot lock and to permit rotation and translation of roller support 104 relative thereto.

Figure 12:
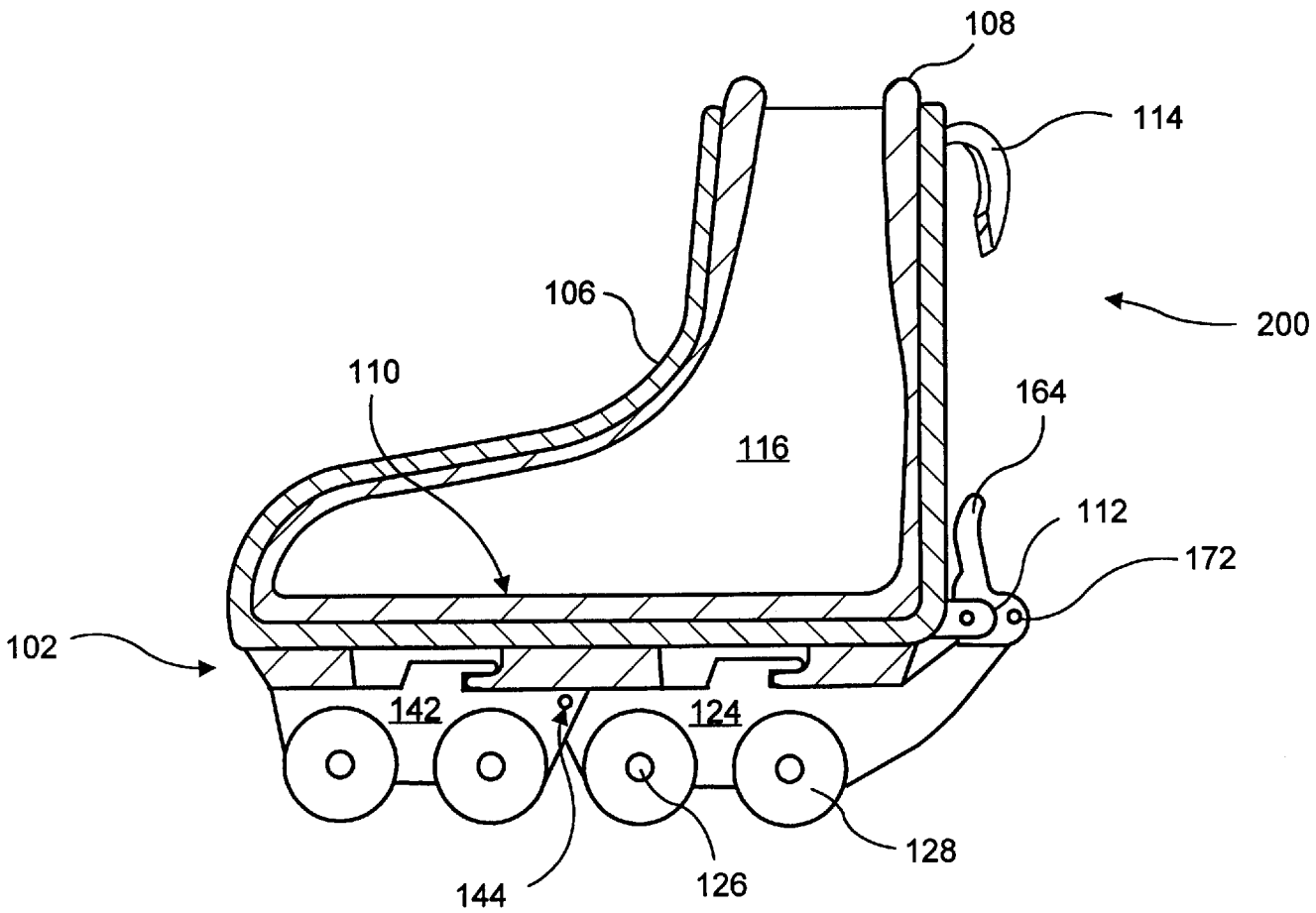
FIG. 12 is a longitudinal, cross-sectional view of a skating/walking support also constructed in accordance with the second embodiment of the present invention. The support illustrated in FIG. 12 occupies the skating state.
Figure 13:
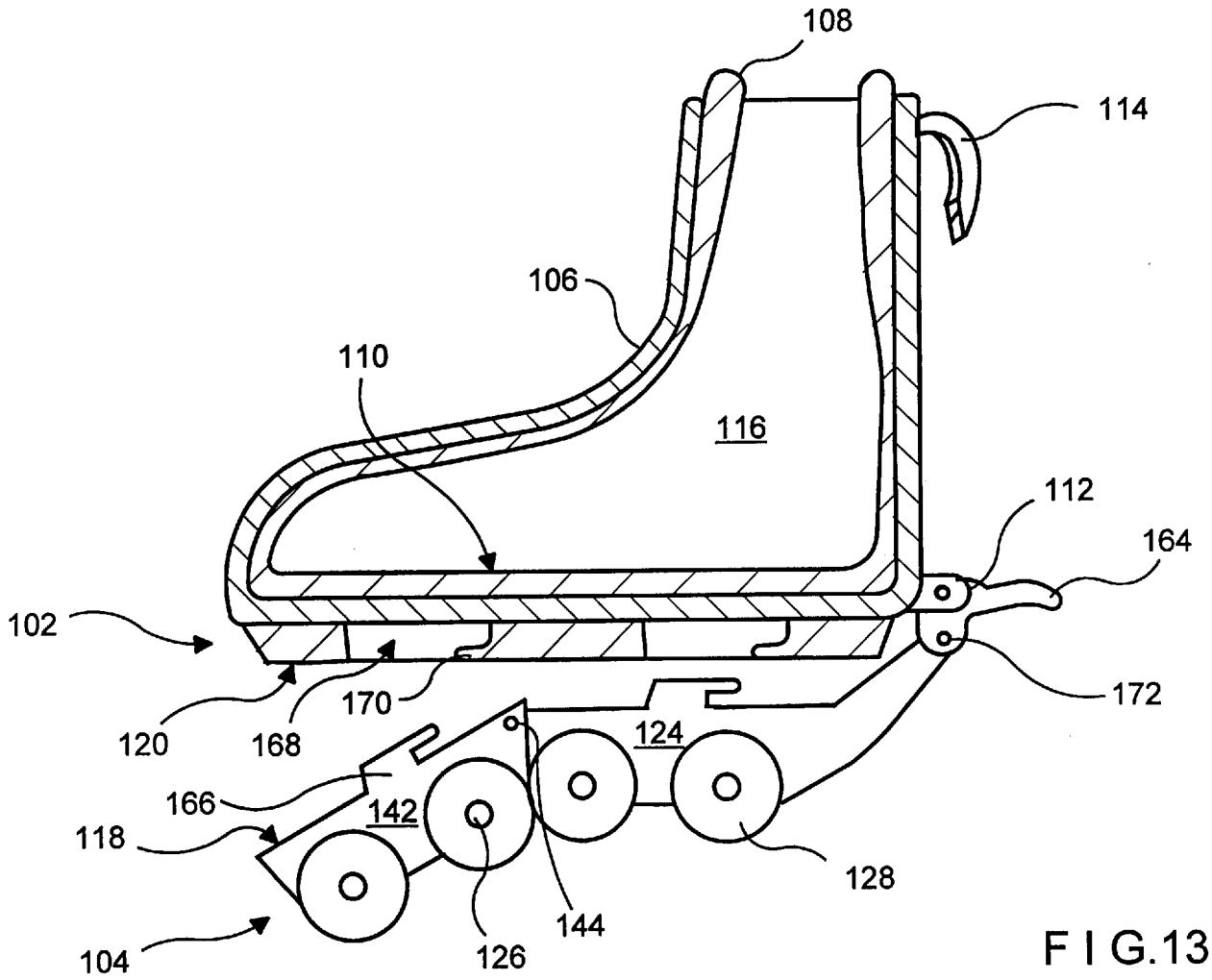
FIG. 13 is a view similar to FIG. 12, however, the support illustrated in FIG. 13 is in transition from the skating state to the walking state.
Figure 14:
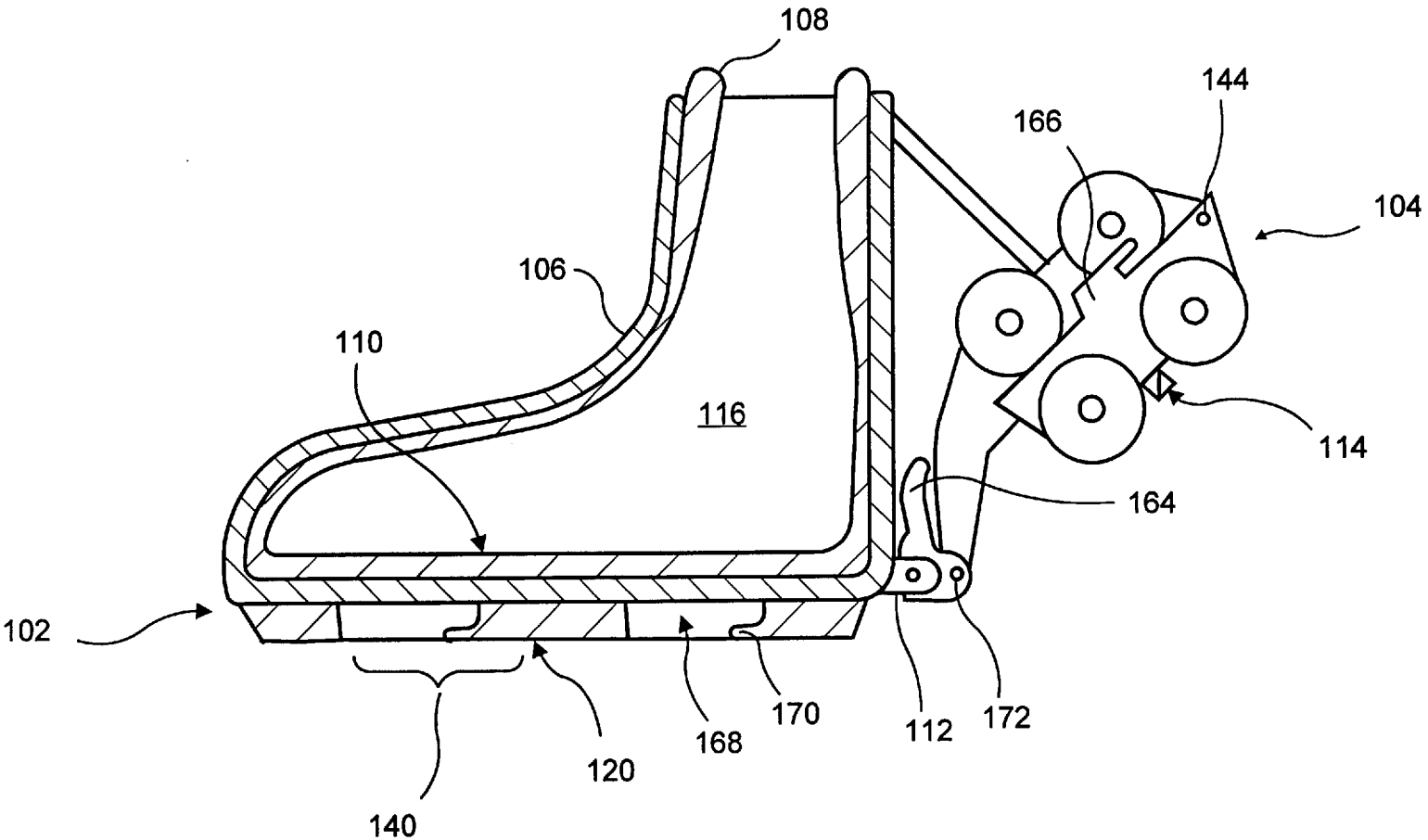
FIG. 14 is a cross-sectional view similar to FIG. 12, however, the support illustrated in FIG. 14 occupies the walking state.

Referring to FIGS. 12 through 14, support 200 according to the second embodiment of the invention provides base 102 and roller assembly 104.

Roller assembly 104 includes first roller support 124 and second roller support 142. First roller support 124 and second roller support 142 are pivotably interconnected by hinge 144. First roller support 124 is pivotably connected to pivot lock 164 and pivot lock 164 is pivotably connected to pivot 112. First and second roller supports 124, 142 are translatable relative to pivot 112.

First and second roller supports 124, 142 each provide locking elements 166 which are adapted to be removably received in mating openings 168 in base 102. Mating openings 168 receive locking elements 166 of first and second roller supports 124, 142 when support 200 occupies the skating state.

Upon release of pivot lock 164, the user may change the state occupied by support 200. As illustrated in FIGS. 13 and 14, during transition from the skating state to the walking state, pivot lock 164 is rotated to permit translation of first and second roller supports 124, 142 relative to base 102. First and second roller supports 124, 142 are translated relative to base 102 until locking elements 166 disengage shoulders 170 of base 102. Second roller support 142 is pivoted relative to first roller support 124 and first roller support 124 is pivoted relative to pivot lock 164 and secured by loop 114 to achieve the walking state.

In order to facilitate the relative movement of first roller support 124 to second roller support 142, first and second roller supports 124, 142 may arrange rollers 128 in a non-linear arrangement when support 200 occupies the skating state.

Figure 15:
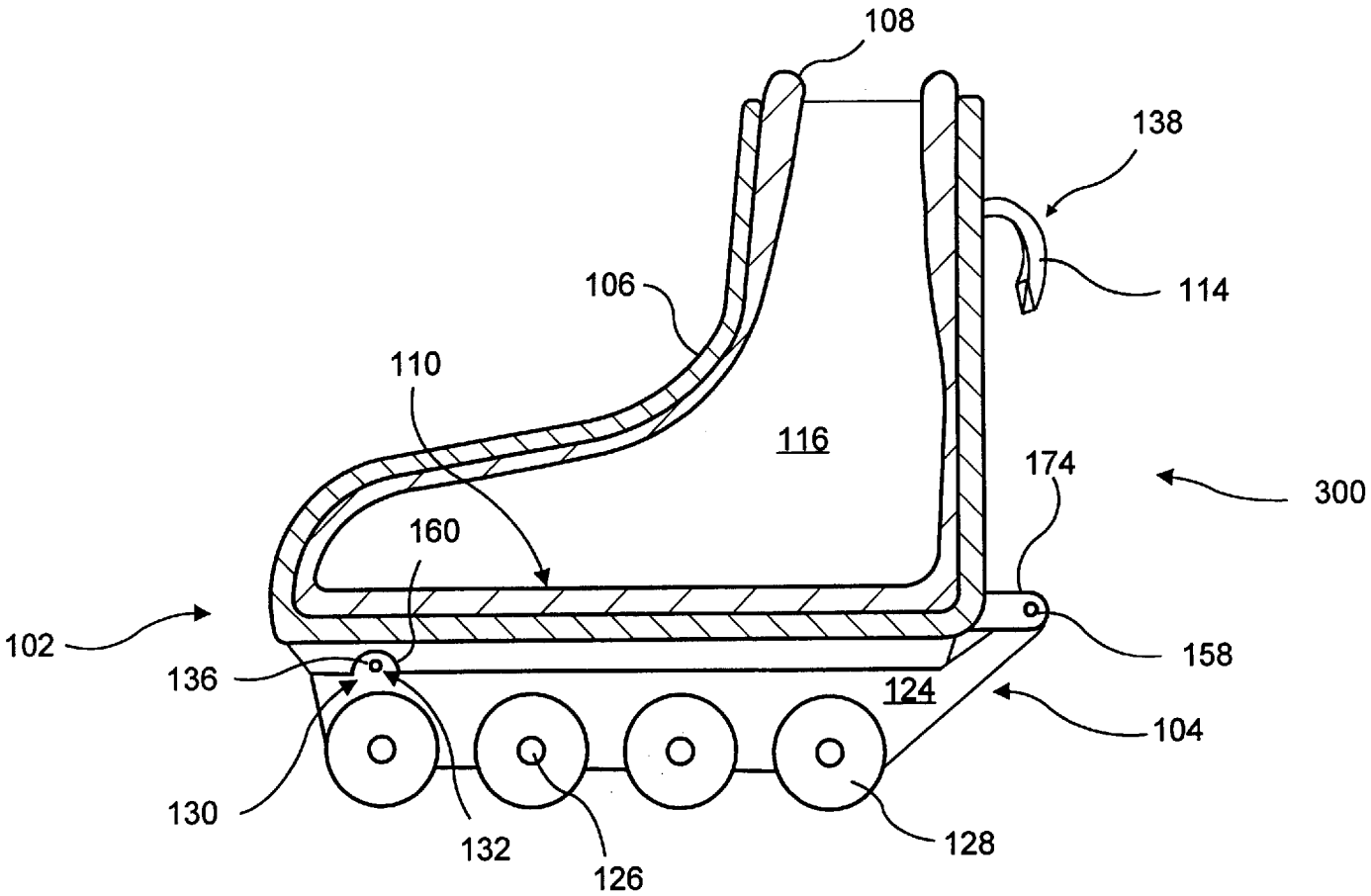
FIG. 15 is a longitudinal, cross-sectional view of a skating/walking support constructed in accordance with the third embodiment of the present invention. The support illustrated in FIG. 15 occupies the skating state.
Figure 16:
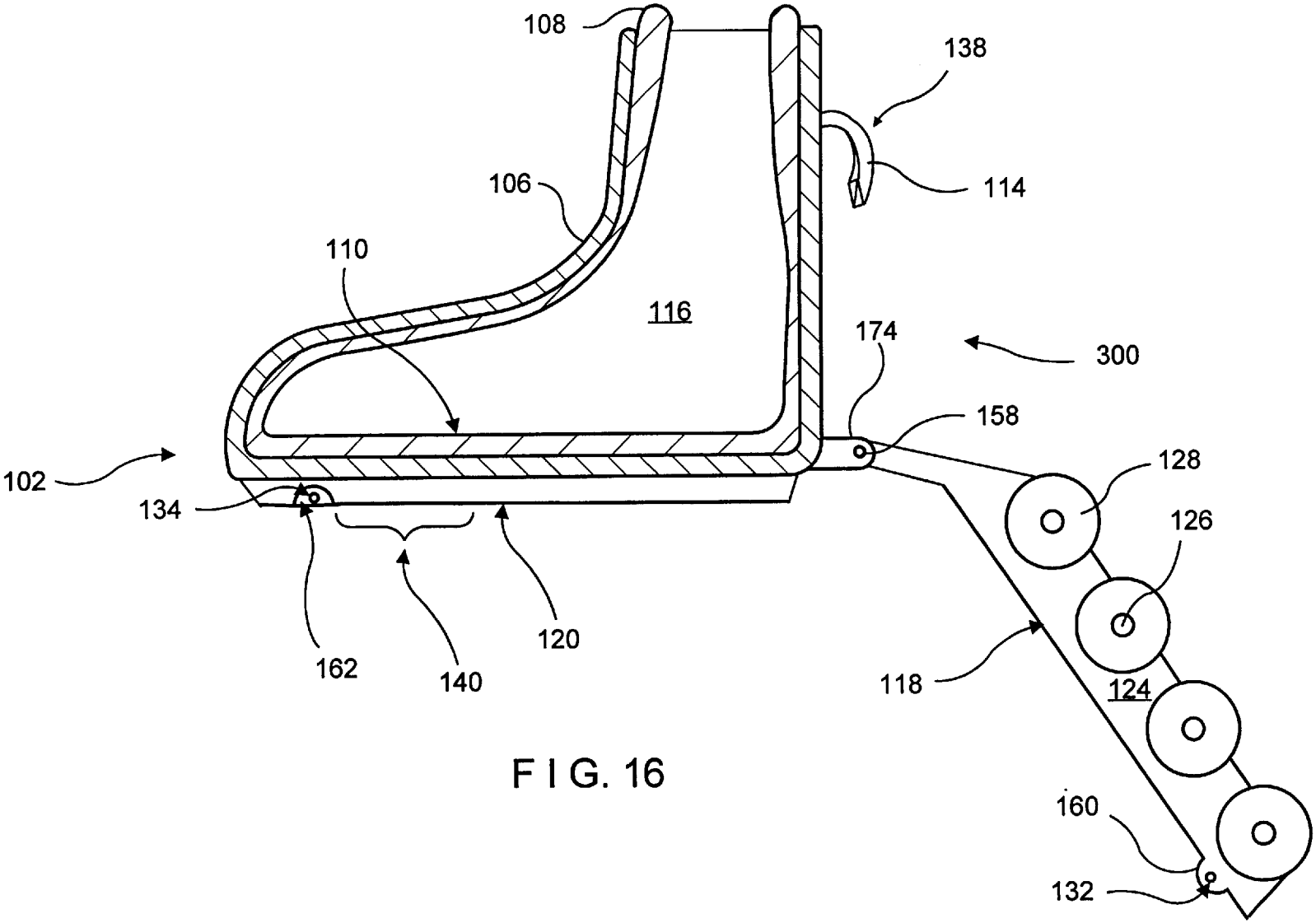
FIG. 16 is a view similar to FIG. 15, however, the support illustrated in FIG. 16 is in transition from the skating state to the walking state.
Figure 17:
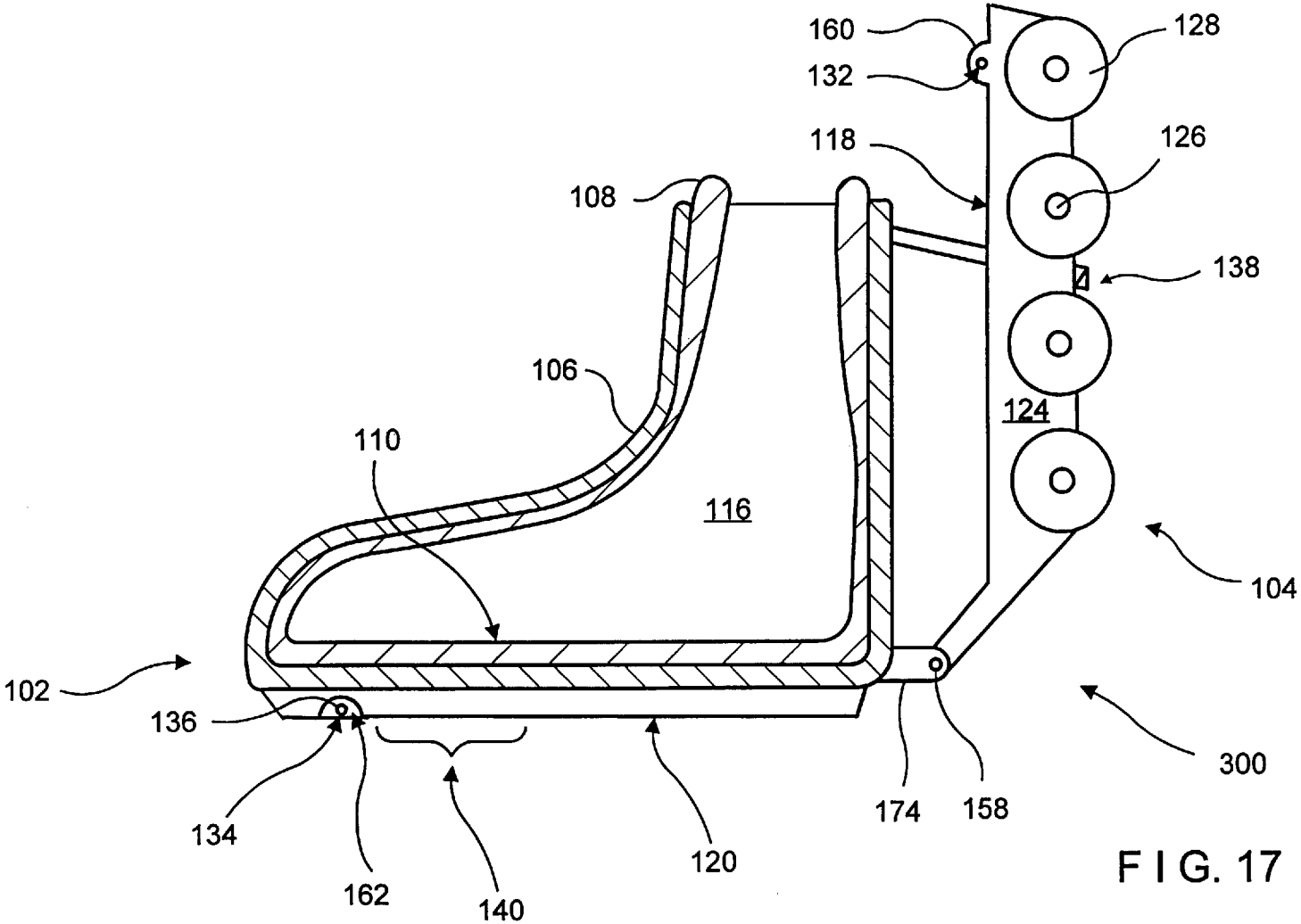
FIG. 17 is a cross-sectional view similar to FIG. 15, however, the support illustrated in FIG. 17 occupies the walking state.

Referring to FIGS. 15 through 17, support 300 according to a third embodiment of the invention provides base 102 and roller assembly 104. Base 102 provides recess 162. Recess 162 is adapted to mate with shoulder 160 of roller assembly 104 to position and stabilize roller assembly 104 when support 300 occupies the skating state.

Roller assembly 104 provides roller support 124, axel and bearings 126, and rollers 128. When shoulder 160 of roller support 124 engages recess 162 of base 102, support 300 occupies the skating state.

Either roller assembly 104 or base 102 or both roller assembly 104 and base 102 provide means 130 for releasably securing roller assembly 104 to base 102. As illustrated in FIGS. 15 through 17, releasable securing means 130 includes aligned openings 132, 134 in roller support 124 and base 102, respectively, and corresponding removable mating pin 136.

Support 300 provides releasable roller securing means 138 for releasably securing roller assembly 104 in the walking position. As illustrated in FIGS. 15 through 17, releasable roller securing means 138 provides elastic loop 114.

It is preferable that base 102 provides resilient zone 140 which is adapted to align with the ball of a skater's foot. While support 300 occupies the walking state, base 102 is flexible, at least in resilient zone 140, to facilitate comfortable walking when support 300 occupies the walking state. Roller support 124 is sufficiently rigid so as to minimize flexibility in resilient zone 140 to facilitate comfortable skating when support 100 occupies the skating state.

Base 102 provides swivel/pivot element 174. Swivel/pivot element 174 swivels relative to base 102 and provides pin 158 which permits pivoting of roller assembly 104 relative to base 102. Swivel/pivot element 174 may be constructed as a ball and socket joint.

Upon removal of pin 136, the user may change the state occupied by support 300. As illustrated in FIGS. 16 and 17, during transition from the skating state to the walking state, roller assembly 104 is pivoted relative to base 102 through pivoting action of swivel/pivot element 174. Roller assembly 104 is then swiveled relative to base 102 about swivel/pivot element 174 from the position illustrated in FIG. 16 to achieve the walking state illustrated in FIG. 17.

Figure 18:
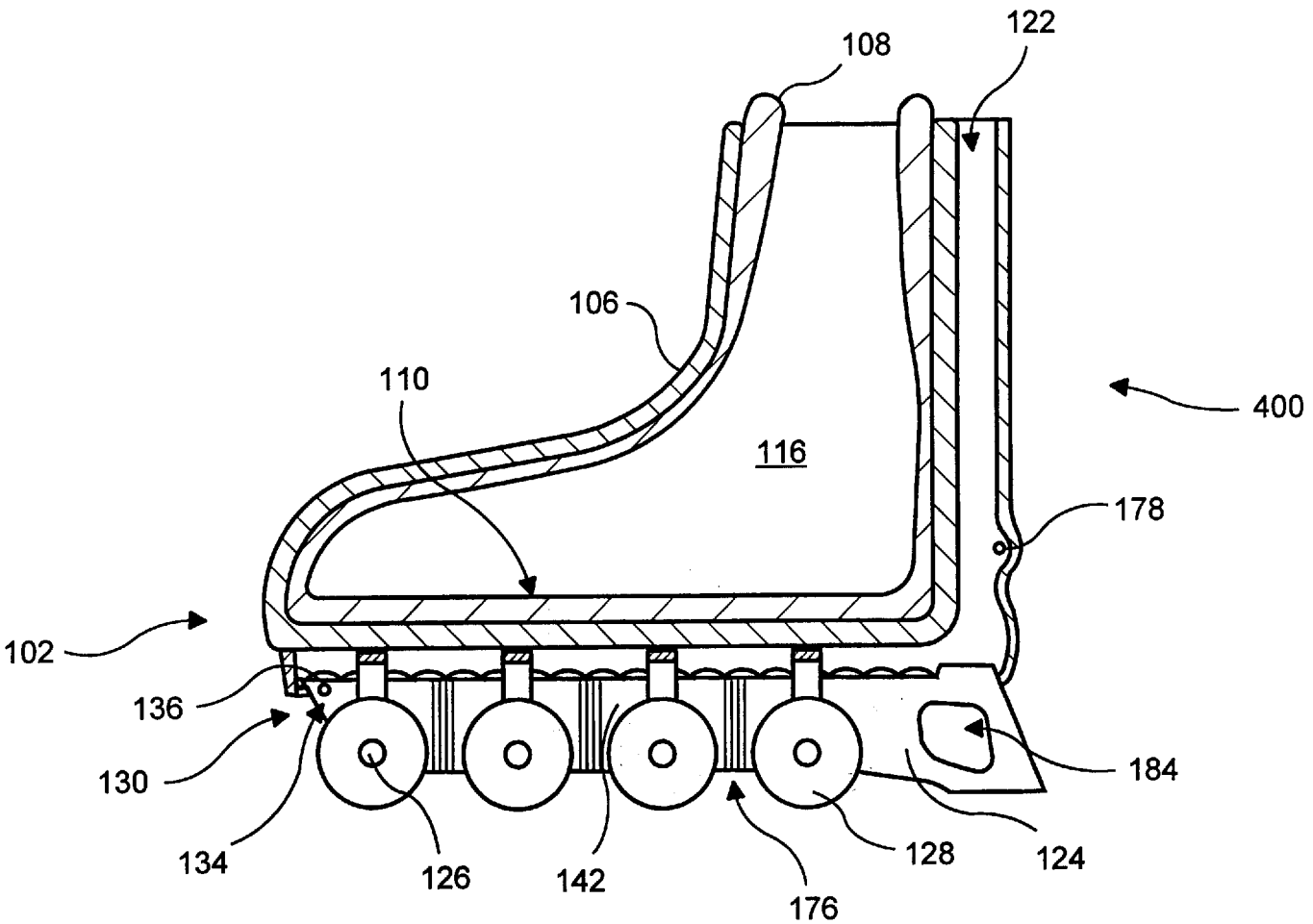
FIG. 18 is a longitudinal, cross-sectional view of a skating/walking support constructed in accordance with the fourth embodiment of the present invention. The support illustrated in FIG. 18 occupies the skating state.
Figure 19:
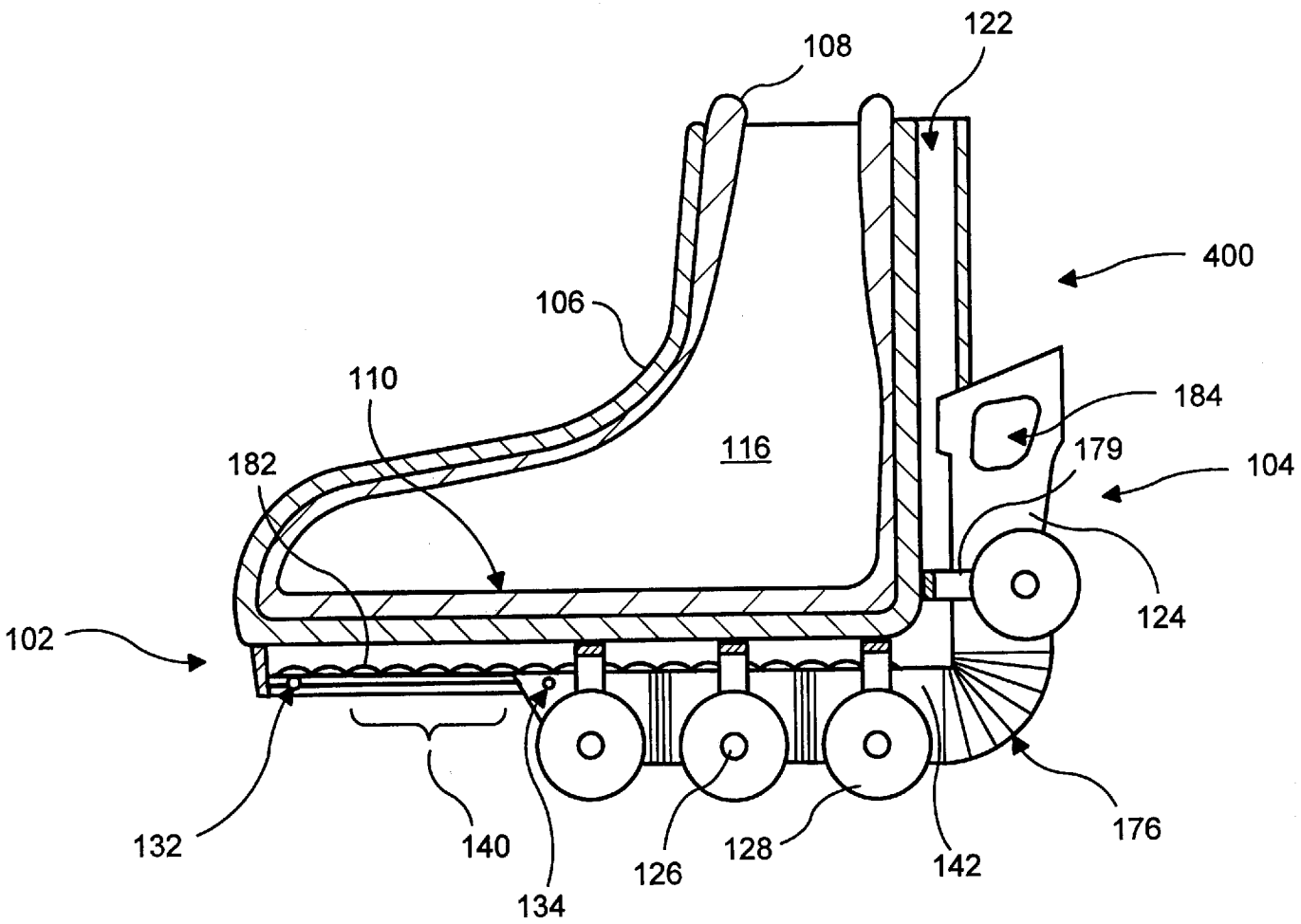
FIG. 19 is a view similar to FIG. 18, however, the support illustrated in FIG. 19 is in transition from the skating state to the walking state.
Figure 20:
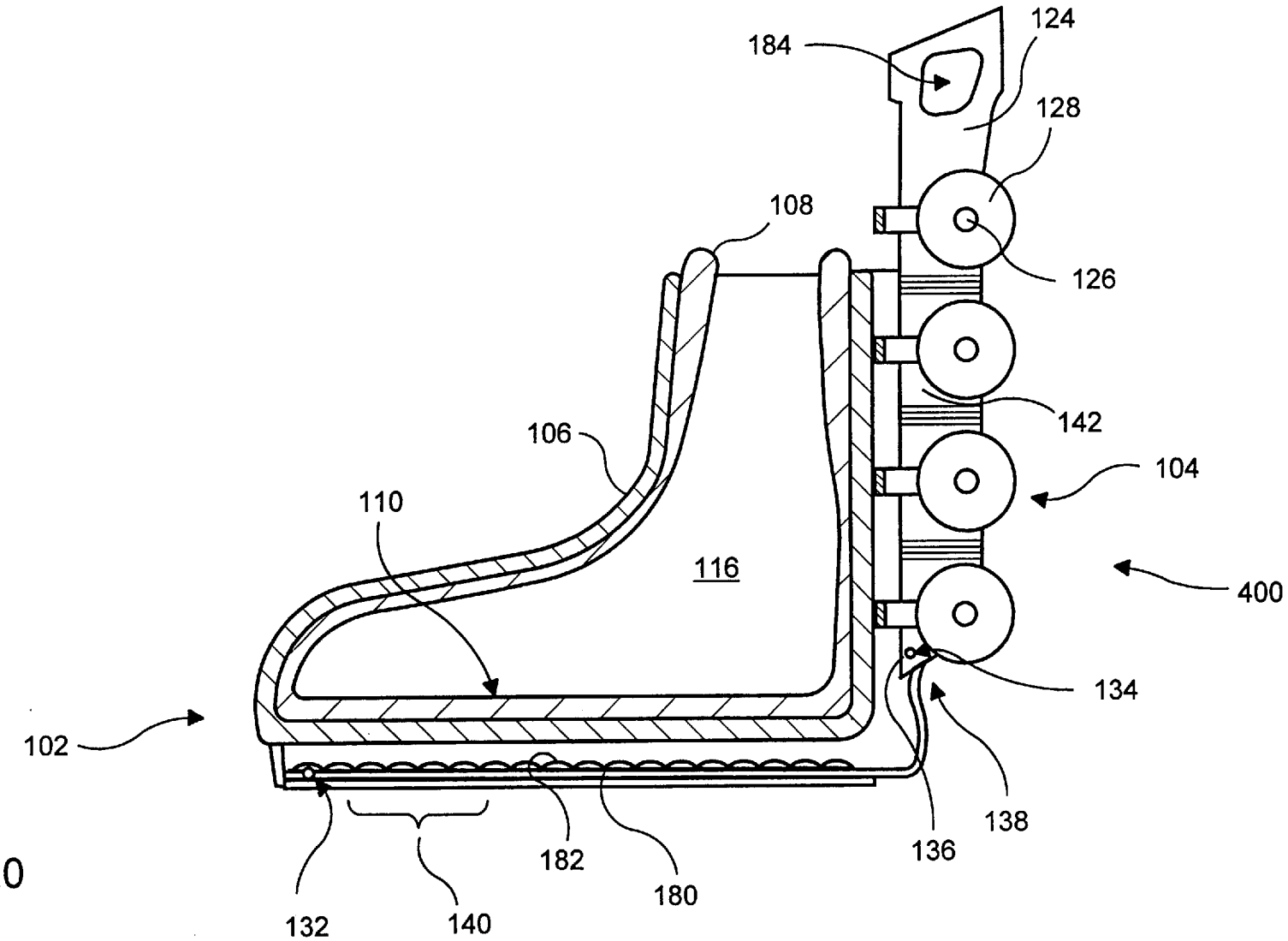
FIG. 20 is a cross-sectional view similar to FIG. 18, however, the support illustrated in FIG. 20 occupies the walking state.

Referring to FIGS. 18 through 20, support 400 according to a fourth embodiment of the present invention provides base 102 and roller assembly 104.

Roller assembly 104 includes first roller support 124 and second roller support 142. First roller support 124 and second roller support 142 are pivotably interconnected by webbing 176. First roller support 124, webbing 176, and second roller support 142 are translatable relative to base 102.

Base 102 provides stabilizing channel 122. Stabilizing channel 122 positions retention elements 179 of first roller support 124 and second roller support 142 and controls motion thereof relative to base 102. Openings 132 and 178 communicate with stabilizing channel 122 and when aligned with opening 134 in roller assembly 104, each provides a securing means. More specifically, openings 132 and 134 are aligned and pin 136 is inserted therethrough when support 400 occupies the skating state. Similarly, when openings 178 and 134 are aligned and pin 136 is inserted therethrough, support 400 occupies the walking state. Preferably, shoulder 180 of stabilizing channel 122 provides bearings 182 which facilitate movement of roller assembly 104 relative to base 102.

Upon removal of pin 136, the user may change the state occupied by support 400. As illustrated in FIGS. 19 and 20, during transition from the skating state to the walking state, first and second roller supports 124, 142 are translated relative to base 102. Webbing 176 permits the movement of first support 124 in a direction different from the direction of movement of second support 142. Opening 184 in roller assembly 104 is adapted to receive a finger of the user to effect the relative motion of roller assembly 104 and base 102.

Figure 21:
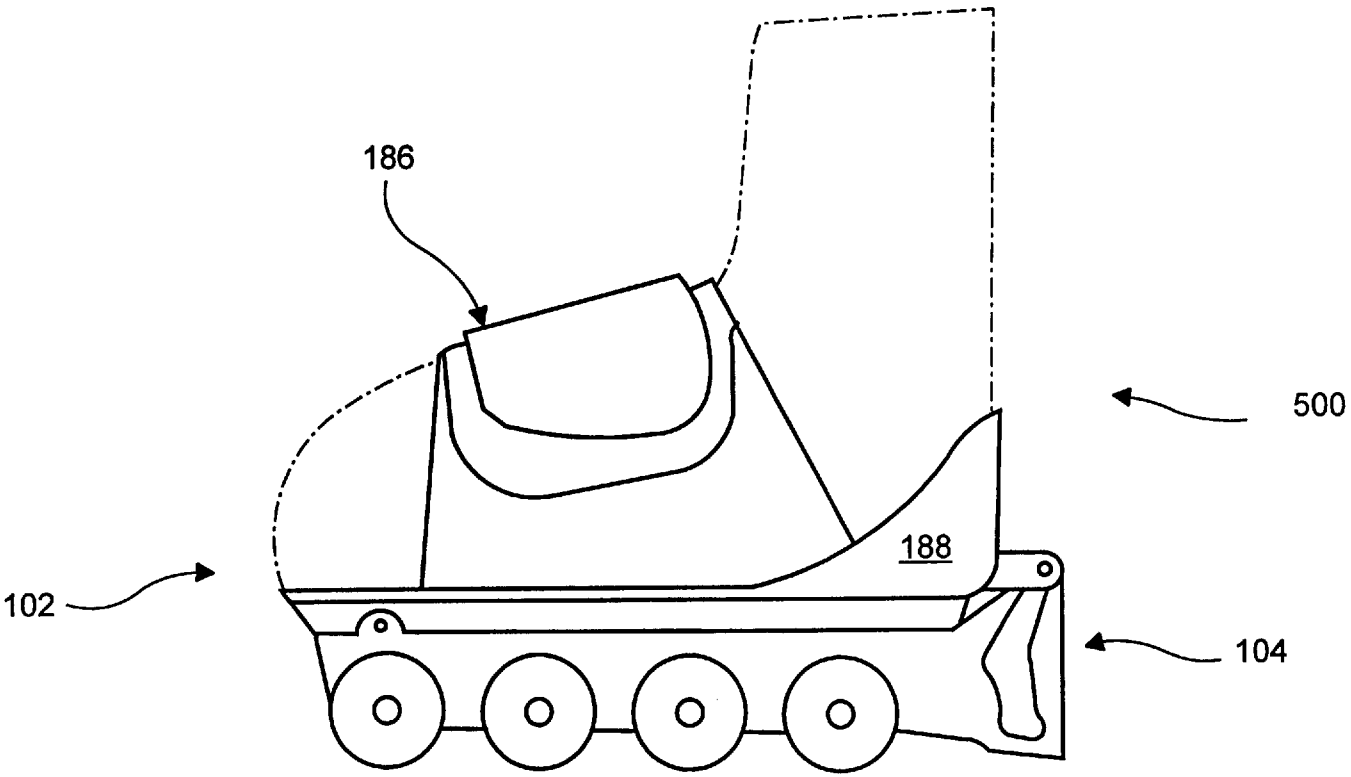
FIG. 21 is a side perspective view of a skating/walking support constructed in accordance with the second embodiment of the present invention. The support illustrated in FIG. 21 is similar to that illustrated in FIGS. 6 through 8, however, the support of FIG. 21 is removable from a shoe (shown in phantom).

Referring to FIG. 21, support 500 is adapted to receive a shoe of a user (shown in phantom). Support 500 provides releasable securing means 186 for securing base 102 to a user's shoe. Base 102 includes shoe positioning element 188 and releasable securing means 186 is adapted to maintain the shoe of the user in contact with the shoe positioning element 188.

As illustrated in FIG. 21, releasable securing means 186 provides belts which interlock using VELCRO. Releasable securing means 186 take the form of removable and adjustable engageable belts having buckles or other equivalent structure.

The structure associated with base 102 and roller assembly 104 may be any of those discussed herein or an equivalent thereof While a number of embodiments have been described having specific features, it is not beyond the scope of the present invention that any one or more features of one embodiment may be combined with any one or more features of other embodiments.

What is claimed is:

1. A skating/walking support comprising:

a base, said base having a support surface, a ground contact surface, and a first pivot element;

a first roller assembly, said first roller assembly pivotally connected to said first pivot element, said first roller assembly being moveable relative to said base between first and second positions to effect a skating state and a walking state of said support, respectively; and, first securing means for releasably securing said first roller assembly in said first position;

second securing means for releasably securing said first roller assembly in said second position;

wherein said first roller assembly comprises;

a roller support, said roller support having first and second elements;

a hinge connecting said first and second elements, said hinge being moveable between open and closed positions, said hinge occupying said closed position when said support occupies said walking state and said hinge occupying said open position when said support occupies said skating state; and, rollers rotatably supported on said roller support.

2. The skating/walking support of claim 1 wherein said rollers are arranged in a non-linear fashion on said roller support.

3. The skating/walking support of claim 1 wherein said rollers are arranged in a linear fashion on said roller support.

4. A skating/walking support comprising:

a base said base having a support surface, a ground contact surface, and a first pivot element;

a first roller assembly, said first roller assembly pivotally connected to said first pivot element, said first roller assembly being moveable relative to said base between first and second positions to effect a skating state and a walking state of said support, respectively;

first securing means for releasably securing said first roller assembly in said first position;

second securing means for releasably securing said first roller assembly in said second position;

a second roller assembly, said second roller assembly pivotally connected to said base at a second pivot element, said second roller assembly being moveable relative to said base between first and second positions to effect a skating state and a walking state of said support, respectively;

first securing means for releasably securing said second roller assembly in said first position; and, second securing means for releasably securing said second roller assembly in said second position;

wherein said first and second roller assemblies each comprise:

a roller support, said roller support having first and second elements;

a hinge connecting said first and second elements, said hinge being moveable between open and closed positions, said hinge occupying said closed position when said support occupies said walking state and said hinge occupying said open position when said support occupies said skating state; and, rollers rotatably supported on said roller support.

5. The skating/walking support of claim 4 wherein said rollers are arranged in a non-linear fashion on said roller support.

6. The skating/walking support of claim 4 wherein said rollers are arranged in a linear fashion on said roller support.

7. A skating/walking support comprising:

a base, said base having a support surface and a ground contact surface providing a longitudinal channel;

a first flexible roller assembly, said first flexible roller assembly being received by the longitudinal channel in said ground contact surface and being slidable relative to said base between first and second positions to effect a skating state and a walking state of said support, respectively;

securing means for minimizing movement of said flexible roller assembly in a direction perpendicular to the longitudinal channel when said support occupies said skating state;

first securing means for releasably securing said first roller assembly in said first position; and, second securing means for releasably securing said first roller assembly in said second position.

8. The skating/walking support of claim 7 wherein said flexible roller assembly comprises:

a flexible roller support adapted to slide within the longitudinal channel of said ground contact surface; and, rollers rotatable relative to said flexible roller support.

9. The skating/walking support of claim 8 wherein said rollers are arranged in a non-linear fashion on said roller support.

10. The skating/walking support of claim 8 wherein said rollers are arranged in a linear fashion on said roller support.

11. The skating/walking support of claim 7 further comprising:

a foot enclosure for receiving a user's foot when said support is used as a skate/shoe, said foot enclosure providing a second channel for slidably receiving said flexible roller support.

12. The skating/walking support of claim 7 further comprising:

a foot enclosure for receiving a user's foot when said support is used as a skate/shoe, said foot enclosure defining said second position of said flexible roller assembly.

* * * * *